United States Patent [19]

Townsend

[11] Patent Number: 4,917,070

[45] Date of Patent: Apr. 17, 1990

[54] CABLE GUIDE ASSEMBLY FOR A COMPOUND BOW

[75] Inventor: Robert R. Townsend, Nicholasville, Ky.

[73] Assignee: Quarters Industries, Inc., Nicholasville, Ky.

[21] Appl. No.: 312,808

[22] Filed: Feb. 21, 1989

[51] Int. Cl.[4] ..... F41B 5/00

[52] U.S. Cl. ..... 124/23 R; 124/88; 124/DIG. 1

[58] Field of Search ..... 124/23 R, 24 R, 86, 124/88, 90, 91, DIG. 1

[56] References Cited

U.S. PATENT DOCUMENTS

| | | | |
|---|---|---|---|
| 4,452,222 | 6/1984 | Quartino et al. | 124/24 R |
| 4,542,732 | 9/1985 | Troncoso | 124/24 R |
| 4,596,228 | 6/1986 | Smith | 124/23 R |
| 4,660,536 | 4/1987 | McPherson | 124/24 R |

OTHER PUBLICATIONS

Saunders Archery Advertisement, "Bow and Arrow", Oct. 1984, p. 19.

Total Shooting Systems advertisement, Dec. 1986.

*Primary Examiner*—Randolph A. Reese

*Assistant Examiner*—John A. Ricci

*Attorney, Agent, or Firm*—King & Schickli

[57] ABSTRACT

A cable guide assembly for a compound bow is disclosed. The guide assembly includes a spindle having a central bore for receiving the bow mounted offset cable rod. A pair of cable rollers are rotatably retained upon the spindle to receive and guide the two runs of the tensioning cable. A plurality of stationary ball bearings are provided in the wall of the spindle to slidingly engage both the cable rod and the rollers to provide the low friction action. During operation of the bow, either during drawing or release, the limbs of the bow flex, imparting an orthogonal (up and down) as well as an axial (back and forth) motion to the tensioning cable. Advantageously, the rotating action of the rollers accomodates the up and down motion of the cable. Concurrently, the guide assembly freely slides upon the rod to accomodate the axial motion of the cable. Thus, the roller assembly allows free, unrestricted cable motion at all times, resulting in a truer, more accurate flight of the arrow, as well as increased hitting power.

6 Claims, 2 Drawing Sheets

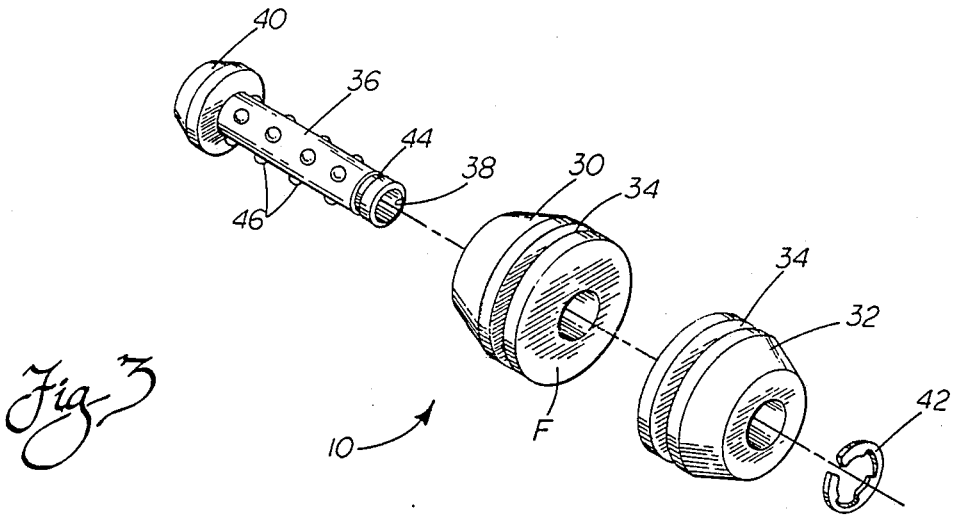
Fig. 3
Fig. 4
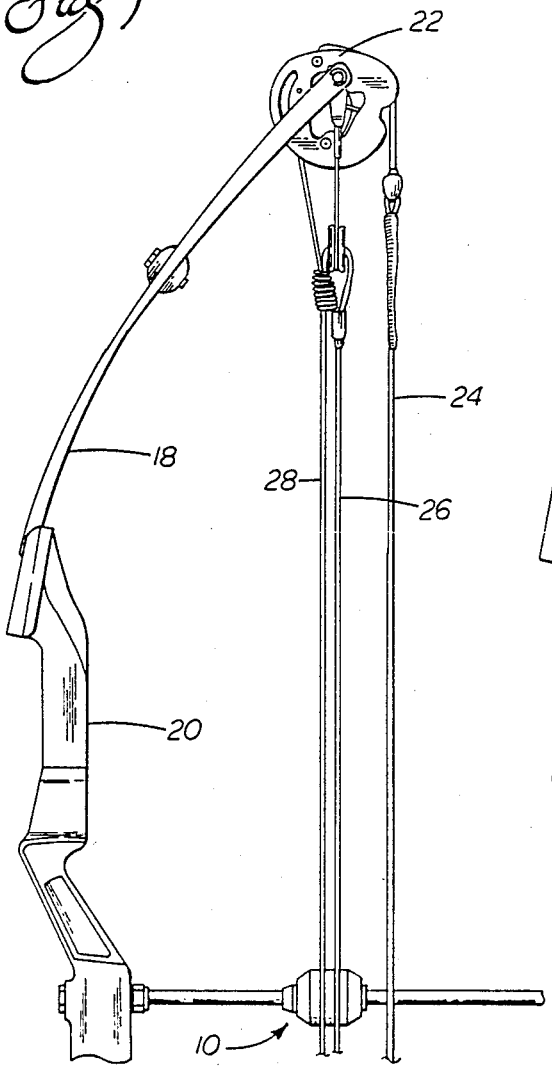
Fig. 5
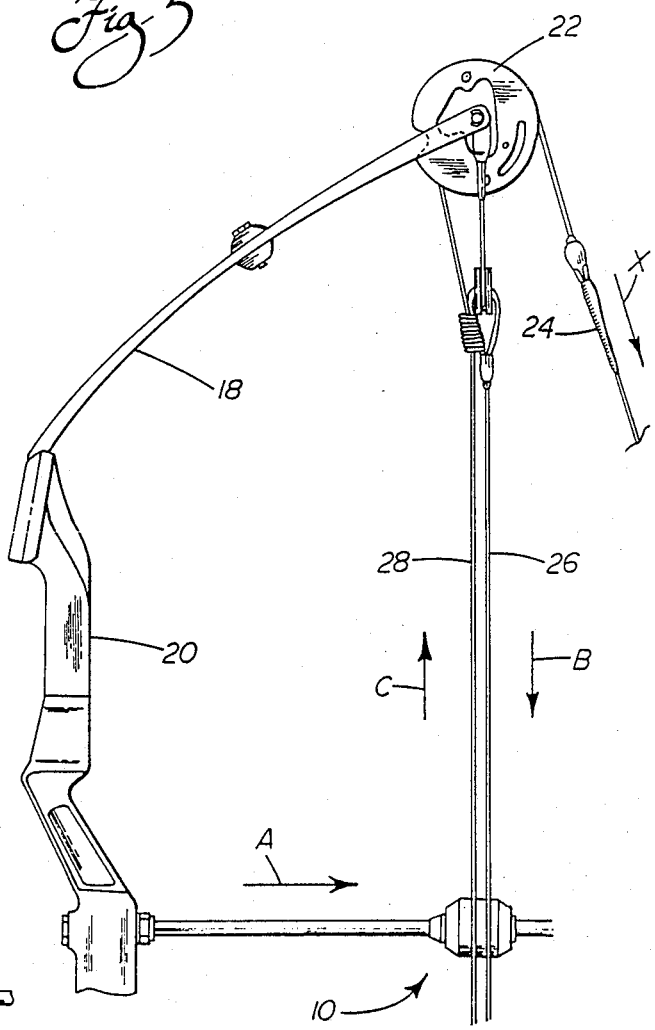

CABLE GUIDE ASSEMBLY FOR A COMPOUND BOW

BACKGROUND

The present invention pertains to hunting/sport bows and more particularly, to a compound bow with an improved, low friction cable guide assembly.

The sport of bow hunting is enjoying widespread popularity. Today, the compound bow is widely used and preferred by many bow hunters and sports enthusiasts. This is because the compound bow provides the advantages of enhanced accuracy coupled with lessened force at full draw due to the mechanical advantage afforded by the compound nature of the bow.

As is known, the mechanical advantage afforded by the compound bow is created by a continuous cable comprised of a tensioning cable connected to a bowstring and passing between two eccentric wheels rotatably mounted at the ends of the limbs. The interaction of the tensioning cable with the wheels during drawing provides a multiplication of force. The action of the eccentric wheels advantageously provides a reduction in the force required during the last half of the draw. This allows the archer to maintain the full draw with reduced effort. As a result, the archer is better able to concentrate on aiming.

A further advantage of the compound bow is a faster arrow flight accompanied by a flatter trajectory. This has an advantage especially in hunting where the exact placement of the arrow as well as high arrow speeds are desirable.

Generally, the tensioning cable arrangement and the bowstring lie in a plane common to the axis of the arrow. As is known in the art, an offset rod or similar means is generally provided in order to offset the tensioning cable away from the bowstring in order to accomodate a freer release of the arrow.

A disadvantage in offsetting the tensioning cable lies in frictional losses encountered as the cables pass across the offset rod during use. This friction increases the force required to draw the bow and reduces the distance and accuracy of the arrow in flight. Further, the frictional forces greatly increase wear of the cable. These frictional losses and wear forces are compounded by the fact that the tensioning cable moves not only axially (back and forth) but orthogonally (up and down) as well. This, of course, is due to the movement of the limbs towards one another during drawing and away from one another during release of the bow.

Attempts to reduce this frictional contact in the past have generally centered around providing a slide for the offset rod. The slide includes grooves for positioning the tensioning cable to keep the two cable runs from rubbing against one another as they cross the offset rod. As can be appreciated, these guides are of limited effectiveness because they do not significantly address the problem of frictional losses.

A need exists therefore for an improved low friction cable guide. Such a guide ideally would minimize all frictional losses in the tensioning cable and yet be simple, self-contained and easily fitted onto all available compound bows, using offset rods.

SUMMARY OF THE INVENTION

It is, therefore, a primary object of the present invention to provide a cable guide assembly for a compound bow to provide a low friction interface between the tensioning cable and the offset cable rod as found on many compound bows.

Another object of the present invention is to provide a cable guide assembly to provide a low friction surface for the tensioning cable facilitating smoother and more efficient drawing and release of the bow, thereby enhancing accuracy and hitting power.

Yet another object of the present invention is to provide a cable guide assembly that is self-contained, reliable, inexpensive to manufacture, and easily fitted onto all compound bows using offset rods.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a cable guide assembly provides a low friction interface between the tensioning cable of a compound bow and the offset guide rod mounted upon the bow.

The cable guide assembly of the present invention includes a spindle having a central bore for slidingly engaging the offset cable rod. A pair of rollers are rotatably retained upon the spindle. As will be described in more detail below, the cable guide assembly of the present invention allows substantially friction free motion of the tensioning cable with respect to the offset cable rod during use of the bow.

Compound bows are generally similar in that each includes a pair of flexible limbs extending from a central handle. A pair of eccentric wheels are rotatably mounted on the ends of the limbs. A continuous cable including a bowstring and a tensioning cable is strung between the eccentric wheels and in combination with the wheels provides the desired mechanical advantage to the compound bow.

A practical disadvantage in the basic construction of the compound bows lies in the fact that the tensioning cable and the bowstring both lie in the same plane, colinear with the axis of the arrow to be propelled. Obviously, it is not desirable for the shaft of the arrow, once released from the bowstring to further touch the tensioning cable. This is because the arrow would be slowed due to the frictional contact and possibly diverted from the desired trajectory as well. As a result, compound bow manufacturers have taken to providing offset cable rods to space the tensioning cable portion away from the arrow.

During usage of the bow, the tensioning cable portion moves in two directions with respect to the offset rod. More specifically, when the bow is drawn, the limbs flex as a result of the drawing force exerted by the cables. Thus, the tensioning cable moves axially in a backwards direction toward the archer. Concurrently, the eccentric wheels turn imparting an opposing orthogonal or up and down motion to each of the two runs of the tensioning cable. When the bow is released, the runs of tensioning cable travel in the opposite directions, as well as axially along the offset rod.

Advantageously, the cable guide assembly of the present invention provides for a substantially friction free motion of the tensioning cable in both directions during operation. Each roller includes a groove for receiving one cable run. The rollers operate independently to facilitate the opposite motion of the two cable runs during operation of the bow. In this way, the opposing orthogonal motion is accomodated. Further, the spindle moves axially on the offset rod to accomodate the axial motion of the tensioning cable. Of course, the rollers rotate during the simultaneous axial movement of the spindle and thus the low frictional action is assured at all times.

According to an important aspect of the present invention, a plurality of spaced ball bearings are provided in the spindle and extend inwardly a distance into the bore in order to provide the desired substantially friction free sliding interface between the spindle and the offset rod. Further, the ball bearings extend a distance outwardly from the outer surface of the spindle to provide a low friction surface for the rollers. Thus, the ball bearings provide the desired low friction surface for both the spindle and the rollers, without the necessity of additional lubricants or the like. Therefore, optimum operation can be assured at all times.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 3 is an exploded, perspective view of the cable guide assembly of the present invention;

FIG. 4 is a partial side elevational view of a compound bow utilizing the cable guide assembly of the present invention, the bow being shown in a natural or undrawn state;

FIG. 5 is a partial side elevational view of the bow of FIG. 4, the bow being shown in a fully drawn state.

Reference will now be made in detail to the present preferred embodiment of the invention, an example of which is illustrated in the accompanying drawing.

DETAILED DESCRIPTION OF THE INVENTION

Figure 1:
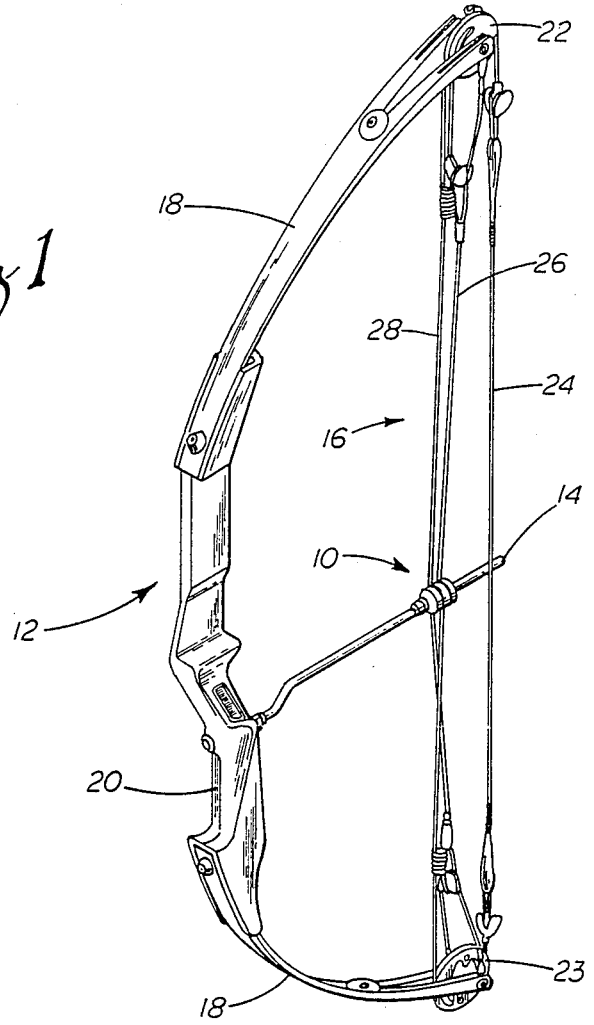
FIG. 1 is a perspective view of a compound bow utilizing the cable guide assembly of the present invention.

Reference is made to FIG. 1 illustrating the cable guide assembly 10 of the present invention mounted upon a compound bow 12. As shown the cable guide assembly 10 is compact, self-contained and can be easily fitted to a large number of available compound bows. As will be appreciated from a review of the following, the cable guide assembly 10 provides for a substantially friction free interface between the offset rod 14 and the tensioning cable 16 of the compound bow 12.

As is known in the art, the compound bow 12 includes a pair of flexible limbs 18 extending outwardly from a central handle 20. A pair of eccentric wheels 22, 23 are rotatably mounted at the ends of the limbs 18. A continuous cable comprising the above tensioning cable 16 and a bowstring 24 is strung between the eccentric wheels 22, 23 and in combination with the wheels 22, 23 provides the desired mechanical advantage characteristic of the compound bow 12. As shown in FIG. 1, the tensioning cable 16 is actually comprised of two separate runs of cable 26 and 28. As shown, for example, the cable run 26 is securely attached to the top end of the bow 12, continues downwardly around the lower eccentric wheel 23 where it meets with the bowstring 24. Similarly, the cable run 28 is securely attached to the other end of the bow 12 and runs upwardly around the upper eccentric wheel 22 to meet with the other end of the bowstring 24. In this way, the continuous cable is created.

The offset rod 14 is provided to space the tensioning cable 16 away from the bowstring 24 and the arrow, (not shown). Thus, the offset rod 14 prevents the arrow from a disadvantageous frictional contact with the tensioning cable 16 during release.

During usage of the bow 12 as illustrated in FIG. 5, the tensioning cable 16 moves in two directions with respect to the offset rod 14. More specifically, when the bowstring 24 is drawn in preparation for shooting (see action arrow X), the limbs 18 flex accordingly. The tensioning cable portion 16 moves axially in the direction of the action arrow A. Simultaneously, the two cable runs 26, 28 move in an orthogonal direction with respect to the offset rod 14. More specifically, the cable run 26 moves downwardly in the direction of action arrow B while the other cable run 28 moves upwardly in the direction of action arrow C. This continues in a diminishing extent until the bowstring 24 is fully drawn.

Upon release of the bowstring 24, the limbs 18 extend to return to the natural position (as shown in FIG. 4) and therefore the action of the tensioning cable 16 is the opposite as above described. Thus, it can be seen that the tensioning cable 16 moves in two directions (axial and orthogonal) with respect to the offset rod 14 during both drawing and release of the bow 12.

Figure 2:
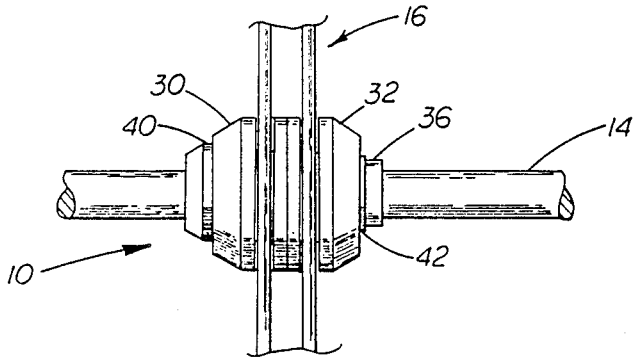
FIG. 2 is an elevational view of the cable guide assembly of the present invention.

Advantageously, the cable guide assembly 10 of the present invention provides for a substantially friction free movement of the tensioning cable 16 with respect to the offset rod 14 in both of these directions. As shown in FIGS. 2 and 3, the cable guide assembly 10 includes a pair of rollers 30 and 32.

On the periphery of each roller is a groove 34 for receiving the cable runs 26, 28 of the tensioning cable portion 16. Each groove 34 serves to retain its roller on the rod 14. That is, because of the tensioned flexing of the cable runs 26, 28 (see FIG. 1), the rollers are restricted in their axial movement to the position wherein the cable runs firmly engage the corresponding groove.

As shown in FIG. 3, the rollers 30, 32 are independent and thus can accomodate the opposite directional motion of the cable runs 26, 28. The rollers 30, 32 are fabricated from a low friction thermoplastic material and contact each other during operation through opposing faces F in a low friction manner. If desired, a friction reducing means, such as a washer of Teflon or the like (not shown) can be inserted between the faces F of the rollers 30, 32 to even further reduce any frictional contact.

The rollers are mounted upon a spindle 36. As shown in FIG. 3, the spindle 36 includes a longitudinally aligned bore 38 for receiving the offset rod 14. The rollers are retained upon the spindle 36 by a shoulder 40 at one end and a retaining clip 42 received within a corresponding groove 44.

According to an important aspect of the present invention, a plurality of ball bearings 46 are provided within the wall of the spindle 36. Advantageously, the ball bearings extend a distance into the central bore 38 and also a distance outwardly from the outer surface of the spindle 36. Thus, the spindle engages the offset rod 14 through the low frictional contact of the ball bearings 46. Further, the rollers 30, 32 engage the spindle 36 in a desirable low friction interface here again as a result of the ball bearings 46. In the preferred embodiment, the ball bearings 46 are stationary. However, a rotatable mounting may be used effectively, if desired.

In summary, numerous benefits result from utilizing the teachings of the present invention. The cable guide assembly 10 provides a desirable low friction interface between the tensioning cable 16 and the offset rod 14 of the compound bow 12 by freely accomodating the two directional motion of the tensioning cable 16 during drawing and release of the bow. This provides for easier operation as well as contributing to a more accurate trajectory and more powerful hitting force of the arrow.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed:

1. A cable guide assembly for a compound bow, said compound bow including a pair of flexible limbs, wheels rotatably retained at the ends of said limbs, a continuous cable engaging said wheels, and an offset rod, comprising:

a spindle having first and second ends and a longitudinally aligned bore for receiving said offset rod; and roller means rotatably and slidingly mounted upon said spindle, said roller means including a groove for receiving said cable and retaining said roller means upon said offset rod.

2. The cable guide assembly of claim 1 wherein said spindle further includes bearing means for sliding engagement upon said offset rod and for supporting said roller means.

3. The cable guide assembly of claim 2 wherein said bearing means is a plurality of spaced ball bearings mounted within said spindle and extending a distance inwardly into said bore.

4. The cable guide assembly of claim 3 wherein said ball bearings further extend through said spindle and a distance outwardly from said spindle, providing a low friction bearing surface for engagement with said roller means.

5. The cable guide assembly of claim 2 wherein is provided a shoulder at said first end of said spindle and a releasable retaining clip at said second end.

6. The cable guide assembly of claim 1 wherein said roller means is a pair of rollers, each said roller being operatively distinct from the other so as to allow rolling motion in opposite directions.

* * * * *